US011624248B2

(12) United States Patent
Owoeye et al.

(10) Patent No.: US 11,624,248 B2
(45) Date of Patent: Apr. 11, 2023

(54) MANAGING A TUBULAR RUNNING SYSTEM FOR A WELLBORE TUBULAR

(71) Applicant: Saudi Arabian Oil Company, Dhahran (SA)

(72) Inventors: Oladele Owoeye, Dhahran (SA); Ayodeji Abegunde, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/181,204

(22) Filed: Feb. 22, 2021

(65) Prior Publication Data

US 2022/0268113 A1 Aug. 25, 2022

(51) Int. Cl.

*E21B 19/16* (2006.01)
*E21B 19/10* (2006.01)
*E21B 47/00* (2012.01)

(52) U.S. Cl.

CPC ..... *E21B 19/165* (2013.01); *E21B 19/10* (2013.01); *E21B 47/00* (2013.01)

(58) Field of Classification Search

CPC combination set(s) only.
See application file for complete search history.

(56) References Cited

U.S. PATENT DOCUMENTS 4,011,617 A * 3/1977 Toelke ..... E21B 17/006 15/104.04
7,874,352 B2 1/2011 Odell et al.
7,946,356 B2 5/2011 Koederitz et al.
9,404,322 B2 8/2016 Wiedecke et al.
2011/0147010 A1* 6/2011 Ellis ..... E21B 19/10 166/380
2011/0226486 A1 9/2011 Haugen
2012/0152530 A1 6/2012 Wiedecke et al.
2012/0160517 A1 6/2012 Bouligny et al.
2013/0075103 A1 3/2013 Herbel
(Continued)

FOREIGN PATENT DOCUMENTS

WO 2013142950 10/2013

OTHER PUBLICATIONS

PCT International Search Report and Written Opinion in International Appln. No. PCT/US2022/017025, dated May 20, 2022, 18 pages.

*Primary Examiner* — Taras P Bemko
*Assistant Examiner* — Ronald R Runyan
(74) *Attorney, Agent, or Firm* — Fish & Richardson P.C.

(57) ABSTRACT

Techniques for operating a tubular running tool system include communicating, using a controller, one or more sensors coupled to a tubular running tool during a tubular running operation; identifying, with the controller, a first input from one or more sensors that is associated with a weight of one or more tubular members suspended from the tubular running tool during the tubular running operation; identifying, with the controller, a second input from the one or more sensors that is associated with a position of the tubular running tool relative to a reference location during the tubular running operation; based on at least one of the first or second inputs, determining, with the controller, an operation for the tubular running tool; and based on the determination, transmitting, with the controller, a signal to an actuator of the tubular running tool to perform the operation of the tubular running tool.

21 Claims, 5 Drawing Sheets

(56) References Cited

U.S. PATENT DOCUMENTS

| | | | | |
|---|---|---|---|---|
| 2013/0118760 | A1* | 5/2013 | Kuttel | E21B 19/06 166/85.1 |
| 2014/0116686 | A1 | 5/2014 | Odell et al. | |
| 2015/0191162 | A1* | 7/2015 | Dao | H04Q 9/00 701/22 |
| 2018/0023387 | A1 | 1/2018 | Turley et al. | |
| 2019/0257161 | A1 | 8/2019 | Dewald et al. | |
| 2020/0224524 | A1* | 7/2020 | Parmeshwar | E21B 47/09 |
| 2020/0224525 | A1 | 7/2020 | Parmeshwar et al. | |

* cited by examiner

MANAGING A TUBULAR RUNNING SYSTEM FOR A WELLBORE TUBULAR

TECHNICAL FIELD

The present disclosure describes systems and methods for managing a tubular running system for a wellbore tubular.

BACKGROUND

Tubular members or a string of tubular members are used in drilling for, and production of, hydrocarbons from reservoirs located beneath the Earth's surface. Often, such tubular members or string of tubular members (and tools connected to such members) are suspended into a wellbore or actively run into (or out of) the wellbore during operations. As a weight of the tubular members or string of tubular members can become quite large, there are safety concerns to ensure that the members or string do not accidentally become disengaged and fall into the wellbore.

SUMMARY

In an example implementation, a tubular running tool control system includes one or more sensors coupled to a tubular running tool of a rig system during a tubular running operation; and a controller communicably coupled to the one or more sensors and including one or more memory modules that stores instructions, and one or more hardware processors communicably coupled to execute the stored instructions to perform operations. The operations include identifying a first input from one or more sensors that is associated with a weight of one or more tubular members suspended from the tubular running tool of the rig system during the tubular running operation; identifying a second input from the one or more sensors that is associated with a position of the tubular running tool of the rig system relative to a reference location during the tubular running operation; determining, based on at least one of the first or second inputs, an operation for the tubular running tool; and based on the determination, transmitting a signal to an actuator of the tubular running tool to perform the operation of the tubular running tool.

In an aspect combinable with the example implementation, the first input is greater than a preset weight value, and the operation includes maintaining or engaging a gripping assembly of the tubular running tool with at least one of the one or more tubular members.

In another aspect combinable with any of the previous aspects, the preset weight value includes a sum of a weight of the tubular running tool and a travelling block, and the reference depth includes a distance of the tubular running tool above a rotary table of the rig system.

In another aspect combinable with any of the previous aspects, the first input is less than a preset weight value and the second input is below the reference location for the tubular running tool, and the operation includes disengaging a gripping assembly of the tubular running tool with at least one of the one or more tubular members.

In another aspect combinable with any of the previous aspects, the one or more hardware processors is configured to perform operations further including operating the tubular running tool to engage the tubular member at the reference location; and preparing the tubular running tool to engage an additional tubular member to connect to the one or more tubular members.

In another aspect combinable with any of the previous aspects, one or both of the first or second inputs includes a null input, and the operation includes maintaining a previous operation for the tubular running tool; and activating a sensor alarm In another aspect combinable with any of the previous aspects, the one or more hardware processors is configured to perform operations further including identifying a third input from the one or more sensors that is associated with a position of the actuator of the tubular running tool during the tubular running operation; determining, based on the third input, a location or position of a gripping assembly; determining a lateral load on the one or more tubular members based on the determined location or position of the gripping assembly; comparing the determined lateral load to an expected lateral load; and based on the determined lateral load being greater than the expected lateral load, activating an alert signal at the tubular running tool.

In another aspect combinable with any of the previous aspects, the one or more hardware processors is configured to perform operations further including identifying a fourth input from the one or more sensors that is associated with a location of one or more human operators of the tubular running tool during the tubular running operation; determining, based on the fourth input, a location at least one of the one or more human operators within a drop zone of the tubular running tool; and based on the determination, activating an alert signal at the tubular running tool.

In another aspect combinable with any of the previous aspects, the one or more sensors are wirelessly coupled to the controller.

In another aspect combinable with any of the previous aspects, the one or more tubular members include casing or tubing.

In another example implementation, a method for operating a tubular running tool system includes communicating, using a controller that includes one or more hardware processors, with one or more sensors coupled to a tubular running tool of a rig system during a tubular running operation; identifying, with the controller, a first input from the one or more sensors that is associated with a weight of one or more tubular members suspended from the tubular running tool of the rig system during the tubular running operation; identifying, with the controller, a second input from the one or more sensors that is associated with a position of the tubular running tool of the rig system relative to a reference location during the tubular running operation; based on at least one of the first or second inputs, determining, with the controller, an operation for the tubular running tool; and based on the determination, transmitting, with the controller, a signal to an actuator of the tubular running tool to perform the operation of the tubular running tool.

In an aspect combinable with the example implementation, the first input is greater than a preset weight value.

Another aspect combinable with any of the previous aspects further includes operating, with the controller, a gripping assembly of the tubular running tool to maintain or engage with at least one of the one or more tubular members.

In another aspect combinable with any of the previous aspects, the present weight value includes a sum of a weight of the tubular running tool and a travelling block, and the reference depth includes a distance of the tubular running tool above a rotary table of the rig system.

In another aspect combinable with any of the previous aspects, the first input is less than a preset weight value and the second input is below the reference location for the tubular running tool.

Another aspect combinable with any of the previous aspects further includes operating, with the controller, a gripping assembly of the tubular running tool to disengage with at least one of the one or more tubular members.

In another aspect combinable with any of the previous aspects, the present weight value includes a sum of a weight of the tubular running tool and a travelling block, and the reference location includes a distance of the tubular running tool above a rotary table of the rig system.

Another aspect combinable with any of the previous aspects further includes operating, with the controller, the tubular running tool to engage the tubular member at the reference location; and preparing, with the controller, the tubular running tool to engage an additional tubular member to connect to the one or more tubular members.

In another aspect combinable with any of the previous aspects, one or both of the first or second inputs includes a null input.

Another aspect combinable with any of the previous aspects further includes maintaining, with the controller, a previous operation for the tubular running tool.

Another aspect combinable with any of the previous aspects further includes identifying, with the controller, a third input from the one or more sensors that is associated with a position of the actuator of the tubular running tool during the tubular running operation; based on the third input, determining, with the controller, a location or position of a gripping assembly; determining, with the controller, a lateral load on the one or more tubular members based on the determined location or position of the gripping assembly; comparing, with the controller, the determined lateral load to an expected lateral load; and based on the determined lateral load being greater than the expected lateral load, activating, with the controller, an alert signal at the tubular running tool.

Another aspect combinable with any of the previous aspects further includes identifying, with the controller, a fourth input from the one or more sensors that is associated with a location of one or more human operators of the tubular running tool during the tubular running operation; based on the fourth input, determining, with the controller, a location at least one of the one or more human operators within a drop zone of the tubular running tool; and based on the determination, activating, with the controller, an alert signal at the tubular running tool.

Another aspect combinable with any of the previous aspects further includes wirelessly communicating between the one or more sensors and the controller.

Implementations of a tubular running tool control system according to the present disclosure can include one or more of the following features. For example, a tubular running tool control system according to the present disclosure can minimize or eliminate a risk of unintended tubular drop in a wellbore or unintended slip of a tubular being held by a gripping assembly a flush mount spider. As another example, a tubular running tool control system according to the present disclosure can improve tubular running practices on a derrick by minimizing the risk of a dropped object. As a further example, a tubular running tool control system according to the present disclosure can reduce a risk of human error during tubular running tool engagement and disengagement operations. Also, a tubular running tool control system according to the present disclosure can provide for a fully automated system that will only disengage when the tubular is set in slips on the rotary table with no weight below the tubular running tool. Further, a tubular running tool control system according to the present disclosure can serve as an alert system to detect anomalies in gripping efficiency and non-uniform loading of the tubular running tool. As another example, a tubular running tool control system according to the present disclosure can improve operations when running long tubulars in long laterals or horizontal wells. As another example, a tubular running tool control system according to the present disclosure can help improve personnel safety and mitigate risk of other rig equipment damage during casing drilling and pipe tripping operations.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes example implementations of a control system for a tubular running tool. In example implementations, the control system comprises an intelligent and automated tubular deployment system that integrates with a tubular running tool to ensure that the tool running or retrieval system does not disengage from a wellbore when there is weight hanging below the tool during tripping operations or while suspended from a rig. In some aspects, the system can deliver an automated signal for engaging or disengaging the tubular running tool from the wellbore tubular during tripping operations while in a run mode.

Figure 1:
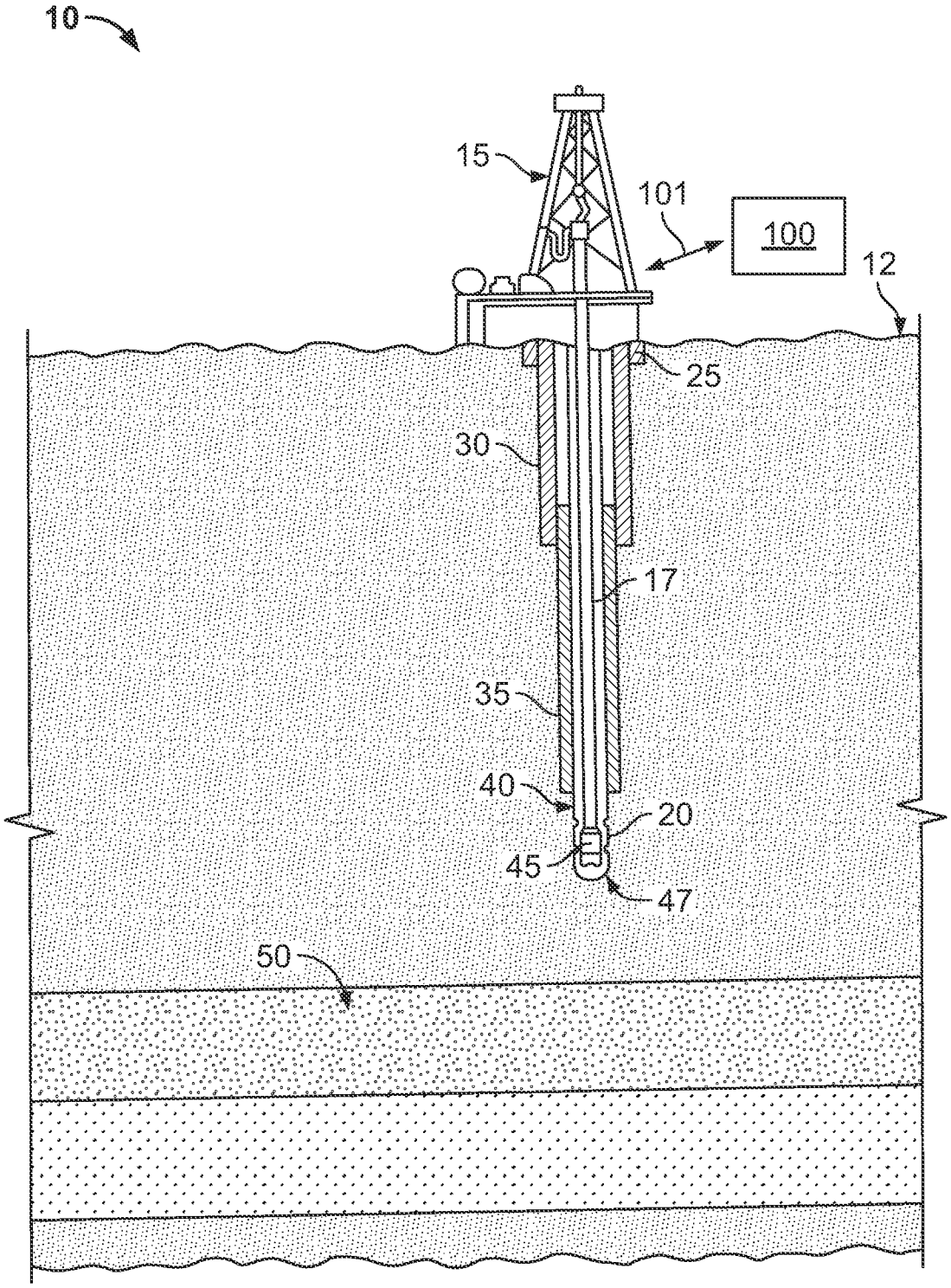
FIG. 1 is a schematic diagram of an example implementation of a wellbore system that includes a tubular running tool control system according to the present disclosure.

FIG. 1 illustrates an example implementation of a wellbore system 10 according to the present disclosure. Generally, the wellbore system 10 accesses one or more subterranean formations, and provides easier and more efficient production of any hydrocarbons located in such subterranean formations. As illustrated in FIG. 1, the wellbore system 10 includes a drilling assembly 15 deployed on a terranean surface 12 for casing drilling. The drilling assembly 15 may be used to form a vertical wellbore portion 20 extending from the terranean surface 12 and through one or more geological formations in the Earth. One or more subterranean formations, such as a target subterranean formation 50, are located under the terranean surface 12. One or more wellbore casings, such as a surface casing 30 and intermediate casing 35, may be installed in at least a portion of the vertical wellbore portion 20. In this example implementation, only a vertical wellbore portion 20 is shown; however, in other example implementations, other portions of the wellbore, such as curved, radiussed, deviated, lateral, slant, or horizontal portion(s) may be included according to the present disclosure.

In some implementations, the drilling assembly 15 may be deployed on a body of water rather than the terranean surface 12 for casing drilling. For instance, in some implementations, the terranean surface 12 may be an ocean, gulf, sea, or any other body of water under which hydrocarbon-bearing formations may be found. In short, reference to the terranean surface 12 includes both land and water surfaces and contemplates forming and/or developing one or more wellbore systems 10 from either or both locations.

Generally, the drilling assembly 15 may be any appropriate assembly or drilling rig used to form wellbores or boreholes in the Earth. The drilling assembly 15 may use traditional techniques to form such wellbores with casing while drilling, such as the vertical wellbore portion 20, or may use nontraditional or novel techniques. In some implementations, the drilling assembly 15 can use rotary drilling equipment to form such wellbores. Rotary drilling equipment can include (among other components as described with reference to FIG. 2) of a casing string 17 and a bottom hole assembly 45. In some implementations, the drilling assembly 15 includes a rotary drilling rig. Rotating equipment on such a rotary drilling rig can include components that serve to rotate a casing drill bit 40, which in turn forms a wellbore, such as the vertical wellbore portion 20, deeper and deeper into the ground. Rotating equipment includes a number of components (not all shown in this figure), which contribute to transferring power from a prime mover to the casing while drill bit 40, itself. The prime mover supplies power to a top drive system, which in turn supplies rotational power through the tubular running tool to the casing string 17. The casing string 17 is typically attached to the casing bit 40 within the bottom hole assembly 45 which could be retrievable or not.

The casing string 17 typically includes sections of heavy steel pipe (for example, tubular members), which are threaded so that they can interlock together. Below the casing string are one or more drill collars, which are heavier, thicker, and stronger than the casing string. The threaded drill collars help to add weight on the casing drill bit 40 to ensure that there is enough downward force on the bit 40 to allow the bit to drill through the one or more troubled geological formations. The number and nature of the drill collars on any particular rotary rig can be altered depending on the downhole conditions experienced while drilling or the casing drilling level selected.

For example, a tubular running tool can be included in the wellbore system 10 and, specifically, the drilling assembly 15. Generally, the tubular running tool can hold at least a portion of the casing string 17 and bottom hole assembly 45 during drilling operations. For instance, the tubular running tool can include one or more gripping elements or slips (either of which as well as other examples can be referred to as a "gripping assembly" according to the present disclosure. The gripping assembly can hold and support a weight of the casing string 17 and bottom hole assembly 45 (and other components) during the casing drilling operation, thereby suspending the casing string 17 and bottom hole assembly 45 in the vertical wellbore portion 20 during rotation.

The casing bit 40 is typically located within or attached to the bottom hole assembly 45, which is located at a downhole end of the casing string 17. The bit 40 is primarily responsible for making contact with the material (for example, rock) within the one or more geological formations and drilling through such material. According to the present disclosure, a casing bit type can be chosen depending on the type of geological formation encountered while drilling. For example, different geological formations encountered during casing while drilling can require the use of different casing bits to achieve maximum drilling efficiency. Regardless of the particular bit selected, continuous removal of the "cuttings" (for example, pieces of the subterranean formation dislodged or cut by the drill bit 40) by a drilling fluid circulating system is part of rotary drilling. In other non-drilling operations that can utilize at least a rig of the drilling assembly 15 (such as secondary recovery or production operations), the tubular running tool can engage and support other types of oil country tubular goods (OCTG), such as production tubing, used for running and retrieving casing strings, and other tubular members.

As illustrated in FIG. 1, the bottom hole assembly 45, including the casing bit 40, drills or creates the vertical wellbore portion 20, which extends from the terranean surface 12 towards the target subterranean formation 50. In some implementations, the target subterranean formation 50 can be a geological formation amenable to drilling with the drilling assembly 15.

In some implementations of the wellbore system 10, the vertical wellbore portion 20 can be cased with one or more casings. As illustrated, the vertical wellbore portion 20 includes a conductor casing 25, which extends from the terranean surface 12 shortly into the Earth. A portion of the vertical wellbore portion 20 enclosed by the conductor casing 25 can be a large diameter borehole. For instance, this portion of the vertical wellbore portion 20 can be a 17-½" borehole with a 13-⅜" conductor casing 25. Downhole of the conductor casing 25 can be the surface casing 30. The surface casing 30 can enclose a slightly smaller borehole and protect the vertical wellbore portion 20 from intrusion of, for example, freshwater aquifers located near the terranean surface 12. The vertical wellbore portion 20 can than extend vertically downward toward a kickoff point 47, which can be between 500 and 1,000 feet above the target subterranean formation 50. This portion of the vertical wellbore portion 20 can be enclosed by the intermediate casing 35. In some implementations, the borehole diameter of the vertical wellbore portion 20 in this portion is approximately 6-¼". Alternatively, the diameter of the vertical wellbore portion 20 at any point within its length, as well as the casing size of any of the aforementioned casings, can be an appropriate size depending on the casing while drilling process.

As shown in FIG. 1, the wellbore system 10 includes a tubular running tool (TRT) control system 100, which is communicably coupled through signals 101 (for example, bidirectional signals 101) to one or more sensors that are part of the drilling assembly 15 as well as one or more components of the drilling assembly 15, including the tubular running tool. In some aspects, the TRT control system 100 comprises a microprocessor based controller that receives inputs from the one or more sensors and provides outputs (for example, in the form of commands or instructions) to the one or more components of the drilling assembly 15. For example, in operation, the TRT control system 100 comprises an intelligent (for example, software based) tubular deployment system that facilitates operation of a gripping assembly of the tubular running tool to ensure that such assembly does not disengage from the casing string 17 when there is weight hanging below the tubular running tool during tripping operations (casing drilling operations or removal of the casing string 17 from the vertical wellbore portion 20) or even while suspended from a rig of the drilling assembly 15. For example, the TRT control system 100 can deliver an automated signal for engaging or disengaging the tubular running tool during tripping operations with the controller 100 in a "run" mode (rather than a "standby" mode).

In some aspects, the TRT control system 100 integrates or includes a programmable logic controller (PLC) and communicates with one or more sensors and one or more actuators associated with or part of the tubular running tool. The TRT control system 100 can (through bidirectional signals 101) monitor various input sensing devices (for example, weight sensor, TRT position/displacement sensor, location sensor of the gripping assembly, pressure and temperature sensor from the TRT actuator control line, fluid flow measurements, and other sensing devices) and produces a corresponding output to one or more actuators (through bidirectional signals 101), which can function to either keep the gripping element engaged or disengaged to the casing string 17 (or other tubular member).

In operation, the TRT control system 100 can prevent tubular slipping and dropping in the wellbore portion 20 when there is weight below the tubular running tool. For example, the TRT control system 100 can be integrated into a hydraulic tubular running tool to function as a safety interlock system while running (relatively) large diameter OCTG tubulars as well as detect anomalies in the gripping assembly-to-pipe efficiency or non-uniform loading of the gripping assembly on the tubular (or both). In addition, zone management features can be implemented by the TRT control system 100 to provide an additional safety barrier to personnel and equipment on or around the drilling assembly 15.

Figure 2:
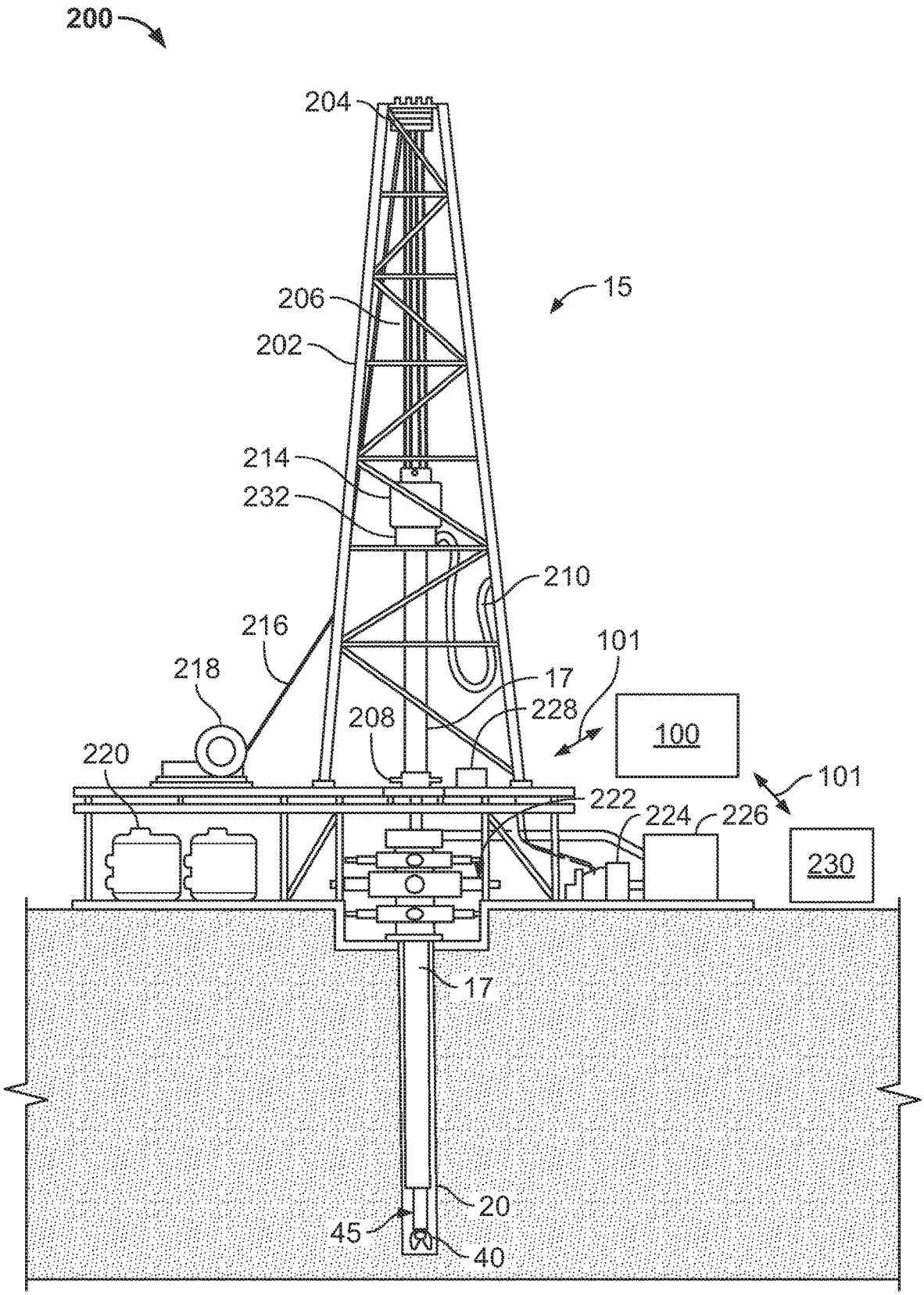
FIG. 2 is a schematic diagram of an example implementation of a drilling system that includes a tubular running tool control system according to the present disclosure.

FIG. 2 is a schematic diagram of an example implementation of a drilling system 200 that includes the tubular running tool control system 100. In some aspects, the drilling system 200 can be used in the wellbore system 10 shown in FIG. 1, and, as shown in FIG. 2, drilling system 200 includes the drilling assembly 15 that operates to form the wellbore 20 by operating casing string 17 to drive the bottom hole assembly 45 including the casing bit 40.

The example implementation of the drilling assembly 15 in FIG. 2 comprises of at least five sub-systems. For example, the drilling assembly 15 includes a hoisting sub-system that is comprised of a draw works 218, a crown block 204, a pulley system 206, and a drilling rig 202. Generally, the draw works 218 is positioned on a floor of the drilling rig 202 and includes a winch drum around which a drilling cable 216 or line (for example, a wire rope), as shown, is spooled. The drilling line 216 is run over the crown block 204 to form the pulley system 206 (which holds a top drive system 214) and is anchored (not shown) at the rig floor.

Another sub-system of the drilling assembly 15 is a rotary sub-system. The rotary sub-system includes (among other conventional components, not shown) the top drive system 214 and a tubular running tool 232. The top drive system 214 works in combination with the tubular running tool 232 to suspend the weight of the casing string 17 (and tools connected to the casing string 17) and can rotate or reciprocate the casing string 17 beneath it as the tubular running tool 232 grips the casing string 17 (with a gripping assembly actuated by an actuator 230 shown schematically in FIG. 2) while keeping the upper part stationary, so that drilling mud can flow out of a standpipe without leaking. The top drive system 214 operates (for example, with one or more motors suspended from the drilling rig 202) to turn a shaft to which the tubular running tool is coupled while the casing string 17 connected to the tubular running tool 232 extends into the wellbore through a rotary table 208 (that may or may not utilize a flush mounted spider). As compared to a Kelly rig, the top drive system 214 can reduce the manual labor involved in drilling, as well as many associated risks. As shown, the top drive system 214 is suspended from the pulley system 206 (which includes a hook located below a traveling block) and can move up and down the drilling rig 202. The tubular running tool 232 can be employed to engage the casing string 17 to ensure that the casing string 17 does not detach from the top drive system 214.

Another sub-system for the drilling assembly 15 is a circulation sub-system. The circulation sub-system is comprised of one or more drilling fluid (mud) pumps 224, one or more storage tanks (or pits) 226 for the mud, a standpipe 210 in which the mud is transported to the bottom hole assembly 45, and a return mud line below the rotary table 214, which returns mud from the wellbore 20 to, for example, a shaker (which removes the drill cuttings before the mud is sent to the mud tanks for cleaning before recirculation). The circulation sub-system pumps the drilling fluids down the wellbore 20, which act as a medium to carry drill cuttings up out of the wellbore 20. The drilling fluid also cools and lubricates the casing bit 40 and bottom hole assembly, controls pressure, and prevents caving of a subterranean formation during the casing drilling process.

Another sub-system of the drilling assembly 15 is a power sub-system. In this example implementation, the power sub-system is comprised of one or more prime movers 220. In some aspects, the one or more prime movers 220 can be engines, such as natural gas or diesel fueled engines. In some examples, the one or more prime movers 220 can be electric motors (for example, alternating current or direct current motors). The one or more prime movers 220 impart rotational energy to the casing string 17 (through the rotary sub-system).

Another sub-system of the drilling assembly 15 is a safety sub-system. In this example implementation, the safety sub-system includes a blowout preventer system 222. Generally, the blow out preventer 222 includes a series of hydraulically operated valves and rams that function to prevent an uncontrolled escape of hydrocarbon fluids (for example, oil or gas or both) during drilling. For example, during a drilling operation, the valves and rams can be open to allow drilling mud to circulate through the casing string 17. If excessive pressure enters the wellbore portion 20, the valves can quickly be closed. If excessive pressure from a subterranean formation suddenly enters the wellbore portion 20 (for example, a kick) casing rams are closed to prevent overpressure reaching the terranean surface. Further, shear rams of the blow out preventer 222 can be activated, which cut through the casing string 17 and seal the wellbore portion 20 if applicable, otherwise the tubular running tool can be disengaged from casing string 17 to allow installation of a safety sub to allow for conventional well control operations with standard drill pipe.

In this example implementation of the drilling system 200, the TRT control system 100 is integrated with one or more of the sub-systems described previously, such as the rotary sub-system and other sub-systems. For example, the TRT control system 100 can be integrated with or communicate with the tubular running tool 232 or the actuator 230 of the tubular running tool 232 (or both). The actuator 230 can be a hydraulic actuator, a pneumatic actuator, a mechanical actuator, an electrical actuator, or a combination thereof. The actuator 230 operates to activate a gripping assembly of the tubular running tool 232 to couple to and hold the casing string 17 or deactivate the gripping assembly of the tubular running tool 232 to release the casing string 17. The actuator 230 functions to keep the gripping assembly of the tubular running tool 232 engaged with (either internally within or externally about) the casing string 17.

In some aspects, the TRT control system 100 is also integrated or includes a sensor package 228, shown schematically in FIG. 2. The sensor package 228 can include one or more sensors or measurement devices that are part of or communicate with one or more sub-systems of the drilling system 200. In some examples, the sensor package 228 includes sensors or measurement devices that determine, for instance, a flow line measurement of the actuator 230, a pressure of the actuator 230 (for example, as a hydraulic actuator), a gripping assembly location, a position of the tubular running tool 232, a signal from a spider that is part of the rotary table 214 (either flush or casing mount), a weight of the casing string 17 (including any tools connected to the casing string 17). Other sensors can measure or determine, for example, pressure and temperatures of other components of the drilling assembly 15, as well as proximity sensors that can detect whether one or more objects (such as human operators) are within a particular radius or other distance of the tubular running tool 232, the casing string 17, or other moving (and heavy) components of the rotary sub-system.

As described in more detail with reference to FIG. 3, in some aspects, the TRT control system 100 communicates with the sensor package 228 (through signals 101) to determine a proper operational position of the gripping assembly of the tubular running tool 232 and, based on the determination, communicates with the actuator 230 (through signals 101) to adjust or maintain the gripping assembly in the proper operations position. For example, the TRT control system 100 can determine whether (or when) there is weight below the tubular running tool 232 and, based on that determination communicate with the actuator 230 to activate (or maintain activation of) the gripping assembly of the tubular running tool 232. By activating or maintaining an activation of the gripping assembly, the gripping assembly can hold and support the casing string 17. Alternatively, the TRT control system 100 can determine whether (or when) there is weight below the tubular running tool 232 and the tubular running tool 232 is above a reference position, and based on that determination communicate with the actuator 230 to activate (or maintain activation of) the gripping assembly of the tubular running tool 232. If there is no weight below the tubular running tool 232, the TRT control system 100 can communicate with the actuator 230 to deactivate (or maintain deactivation of) the gripping assembly of the tubular running tool 232. By deactivating or maintaining a deactivation of the gripping assembly, then casing string 17 is not held or supported by the tubular running tool 232.

In some aspects, the TRT control system 100 also monitors the operation of the actuator 230. For example, as an example of a hydraulic actuator 230, there can be one or more control lines available to supply hydraulic fluid to one or more annular piston assemblies of the actuator 230, as well as a monitoring line to transmit information or data back about the hydraulic fluid supply to the TRT control system 100. This can allow the TRT control system 100 (for example, automatically) or an operator of the TRT control system 100 to monitor the conditions in a hydraulic fluid chamber, such as pressure and temperature within the chamber. Thus, for example, a leak in the actuator hydraulic fluid chamber can be detected.

Figure 3:
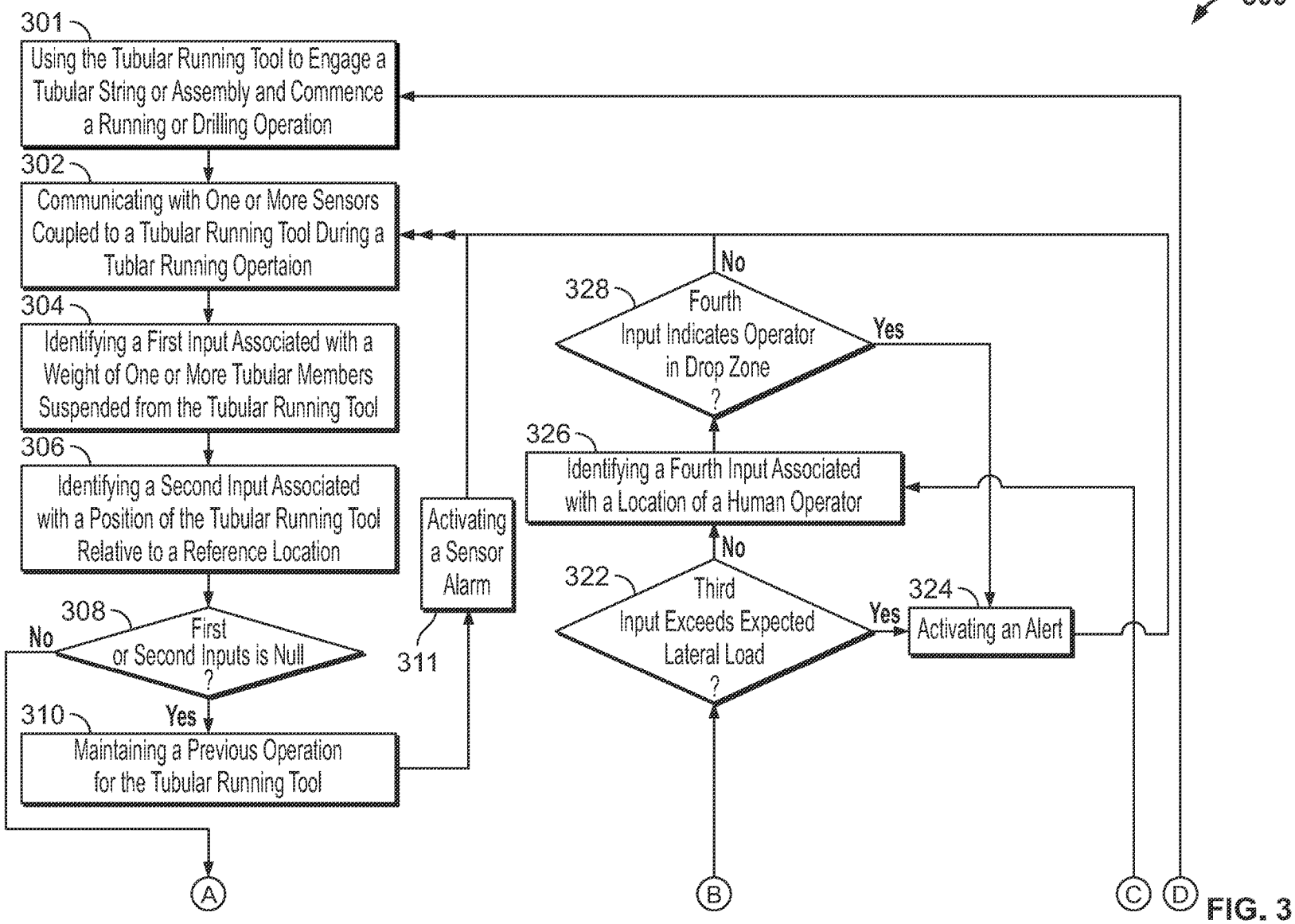
FIG. 3 is a flowchart of an example method performed with or by an example implementation of a tubular running tool control system according to the present disclosure.
Figure 3:
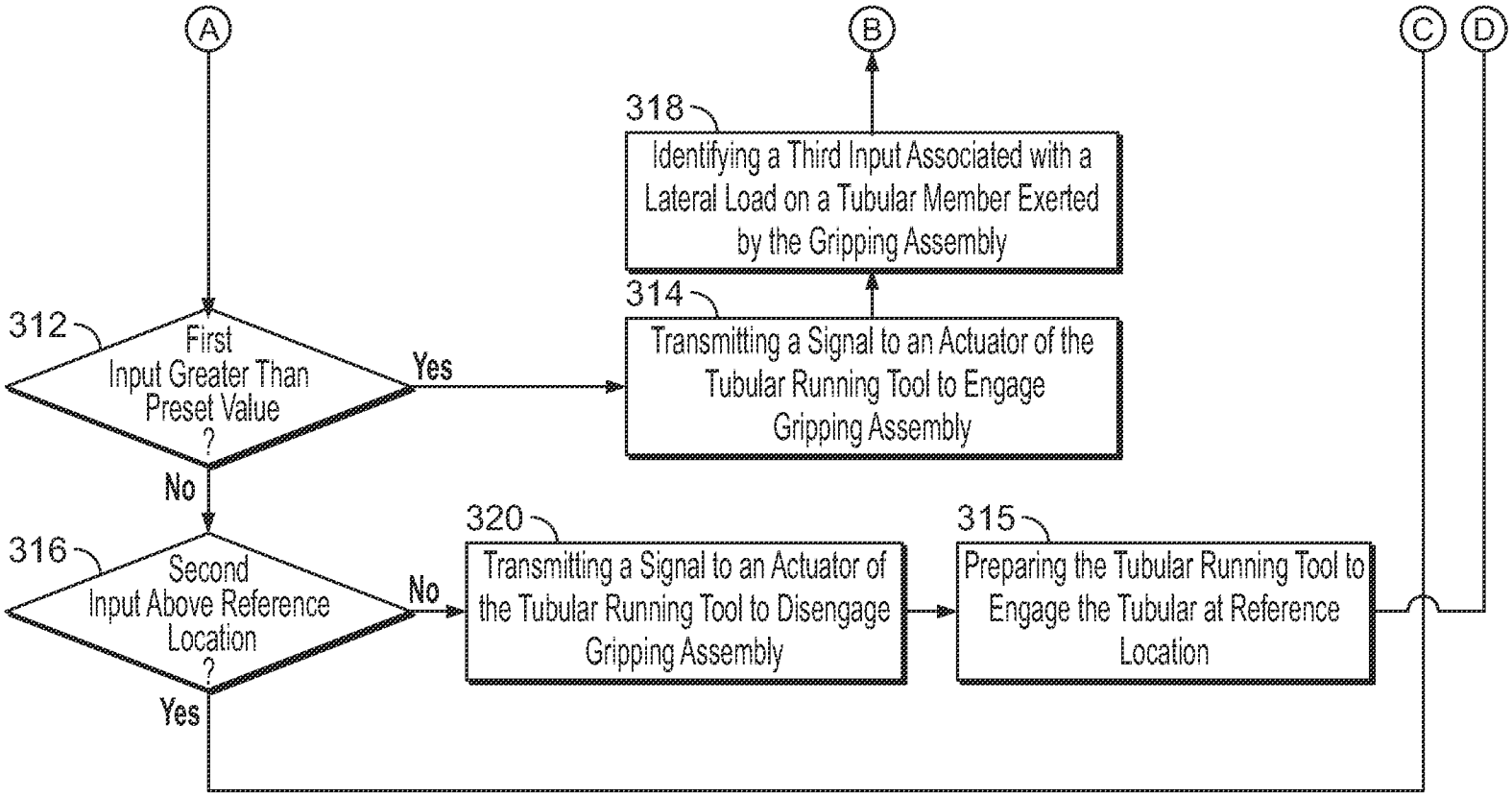

FIG. 3 is a flowchart of an example method 300 performed with or by an example implementation of a tubular running tool control system according to the present disclosure. For example, method 300 can be implemented or executed by the TRT control system 100 (as well as other portions, for example, of the drilling system 200). In some aspects, method 300 can begin at step 301, which includes using the tubular running tool to engage a tubular string or assembly and commence a running or casing drilling operation. For example, the tubular running tool can grip one or more tubular members (for example, within a tubular string such as a drill string) in order to pick up the tubular string, run the tubular string into the wellbore, pull the tubular string from the wellbore, or perform casing drilling operation.

Method 300 can continue at step 302, which includes communicating with one or more sensors coupled to a tubular running tool during a tubular running operation. For example, during a tubular running operation, such as when casing string 17 is being run into or out of the wellbore portion 20, the one or more sensors in the sensor package 228 communicate measured data to the TRT control system 100 through signals 101 (wireless or wired).

Method 300 can continue at step 304, which includes identifying a first input associated with a weight of one or more tubular members suspended from the tubular running tool. For example, at least one of the sensors in the sensor package 228 can include a weight sensor. In some examples, the weight sensor is positioned to measure a weight of the tubular(s), such as the casing string 17 (and any tools coupled to the casing string 17) below the tubular running tool 232. In some aspects, the weight sensor can be coupled or attached to the tubular running tool 232.

Method 300 can continue at step 306, which includes identifying, a second input associated with a position of the tubular running tool relative to a reference location. For example, at least another of the sensors in the sensor package 228 can include a proximity sensor that measures a distance between the tubular running tool 232 and a reference location that can be predetermined (and adjustable) by an operator of the TRT control system 100. In some aspects, the reference location is at the rotary table 214 of the drilling assembly 15. In another example, the reference location is at a casing or flush mount spider if part of the rotary table 214.

Method 300 can continue at step 308, which includes a determination whether either of the first or second inputs is null. For example, in some aspects, one or both of the weight sensor or proximity sensor, while in continuous or periodic communication with the TRT control system 100, return a null signal 101 to the TRT control system 100. If the determination is yes, then method 300 can continue at step 310, which includes maintaining a previous operation for the tubular running tool. For example, upon a null signal, the TRT control system 100 may revert to a default mode in which the TRT control system 100 maintains a previous (or last known) operation of the tubular running tool 232. The TRT control system 100 can maintain the previous operation by providing an output command to the actuator 230 to remain in a previous position before the null signal (e.g., if a valve or a switch of the actuator 230 was open, the TRT control system 100 ensures the actuator 230 keeps the gripping assembly of the tubular running tool 232 engaged to the casing string 17 even with the null signal).

Method 300 can continue from step 310 to step 311, which includes activating a sensor alarm. For example, in some aspects, the determination that the first or second inputs is null can provide for an activation of a visual or audible alarm (or both) to garner an operator's attention. In some aspects, the sensor alarm at the TRT control system 100 indicates null values at the first and second inputs.

In some aspects, which may occur during a null signal event such as in step 308, the TRT control system 100 can include an operator override such that the TRT control system 100 can be removed from a run mode should there be a loss of signal or communication (in other words, a null signal). The manual override can also be activated, for example, when a tubular is stuck, held up during tripping, when excessive set down weight is required to work the tubular free, when the tubular running tool 232 is disengaged and required to pick the next string, or when an alarm is sounded (as explained in more detail later).

If the determination in step 308 is no, then method 300 can continue at step 312, which includes a determination of whether the first input is greater than preset value. For example, the TRT control system 100 can (continuously or periodically) compare the weight input from the weight sensor with a preset value. In some aspects, the preset value is equal to or substantially greater than combined weight of the travelling block 206 and the tubular running tool 232. If the determination in step 312 is yes, then method 300 can continue at step 314, which includes transmitting a signal to an actuator of the tubular running tool to engage a gripping assembly. For example, if the sensed weight exceeds the preset value, then the TRT control system 100 commands (for example, with signals 101) the actuator 230 to activate (hydraulically, electrically, or mechanically) the gripping assembly of the tubular running tool 232 to engage the drill string 17.

Method 300 can continue from step 314 to step 318, which includes identifying a third input associated with a lateral load on a tubular member exerted by the gripping assembly. For example, another one of the sensors in the sensor package 228 can sense or measure (directly or indirectly) a lateral load that the gripping assembly of the tubular running tool 232 exerts on the casing string 17. In some aspects, the lateral load can be a measure or indicator of gripping efficiency of the gripping assembly of the tubular running tool 232.

In an example of an indirect measurement of the lateral load, the TRT control system 100 can determine the lateral load based on a sensed location of the gripping assembly and actuator 230 in combination with the measured weight below the tubular running tool 232. For example, in some aspects, the one or more sensors can include a location sensor (for example, a solid state magnetic field sensor or Hall effect sensor, strain gauge, or any proximity sensor) incorporated with the gripping assembly and one or more components of the actuator 230 (for example, a piston and cylinder assembly in the case of a hydraulic actuator 230). The location sensor communicates by signals 101 with the TRT control system to provide a sensed movement of the actuator component (for example, piston rod). From the sensed movement, the TRT control system 100 can determine engagement and disengagement of the gripping assembly (as well as, in some aspects, pressure and temperature of the hydraulic fluid). Through the sensed movement, a position of the gripping assembly can be determined to detect any anomaly, for example, in a slip arm of the gripping assembly, which is expected to move radially away from the tubular running tool 232 to a fully extended position. The anomaly could be, for example, a partial extension of the slip arm or damage to the slip arm resulting in a non-uniform loading of the gripping element. In other aspects where the gripping assembly involves a gripper ball on a track as part of the tubular running tool 232, the sensed movement can be indicative of the gripper ball failing to get to a raised portion of the gripper ball track (in other words, an optimum gripping position). Based on the sensed movement, the TRT control system 100 can determine the lateral load that the gripping assembly exerts on the casing string 17 through the determined position of the gripping element and the sensed weight hanging below the tubular running tool 232.

Method 300 can continue at step 322, which includes a determination of whether the third input exceeds an expected lateral load. For example, once the TRT control system 100 determines (directly or indirectly) the lateral load, such determination can be compared to an expected (or minimum) lateral load. In some aspects, the expected or minimum lateral load is related to the gripping efficiency and set by an operator. The expected or minimum lateral load can equal or approximate an optimum load (or minimum gripping efficiency) to keep the casing string 17 engaged with the tubular running tool 232. If the determination is yes, then method 300 can continue at step 324, which includes activating an alert. For example, a yes determination can indicate that there is insufficient or abnormal gripping efficiency of the casing string 17 (which could cause a drops event). Activating the alarm, therefore, can include an audible or visual alarm (or both) at the TRT control system 100 that indicates the lack of gripping efficiency.

If the determination in step 322 is no, then method 300 can continue to step 326, which includes identifying a fourth input associated with a location of a human operator. For example, one or more sensors of the sensor package 228 can be or include, for example, a sonic or infrared sensor to detect a location of personnel (or equipment) within a certain area of the drilling assembly 15, such as a red or drop zone (for example, within a circular area centered at the tubular running tool 232).

Method 300 can continue at step 328, which includes a determination of whether the fourth input indicates an operator is in a drop zone. For example, the sonic or infrared sensor can detect whether or not a human operator (or other equipment) is within the red or drop zone. If the determination is yes, then method 300 can continue at step 324, which includes activating an alert. For example, the TRT control system 100 can activate an audible or visual alarm (or both) at the drilling assembly 15 (and at the TRT control system 100) that indicates the presence of a human operator in the red or drop zone. If the determination in step 328 is no, then method 300 can continue back to step 302 for example.

If the determination in step 312 is no (for example, the weight is not above the preset value), then method 300 can continue at step 316, which includes a determination of whether the second input is above the reference location. For example, based on the output of the proximity sensor, the TRT control system 100 can determine if the tubular running tool 232 is above the reference location or at the reference location.

If the determination in step 316 is no (for example, the tubular running tool is at the reference location), then method 300 can continue at step 320, which includes transmitting a signal to an actuator of the tubular running tool to disengage a gripping assembly. For example, when the TRT control system 100 determines that the weight below the tubular running tool 232 (for example, the casing string 17 and related tools) is below the preset value and the tubular running tool is at the reference location, then the TRT control system 100 commands (for example, with signals 101) the actuator 230 to activate (hydraulically, electrically, or mechanically) the gripping assembly of the tubular running tool 232 to disengage from the casing string 17.

Method 300 can continue from step 320 to step 315, which includes preparing the tubular running tool to engage the tubular at the reference location. This is done, for example, so that an additional tubular member can be connected to casing string 17. Either of the options can result in method 300 proceeding back to step 301.

If the determination in step 316 is yes, then method 300 can continue to step 326, as described above.

Method 300 may also include other steps. For example, in between or as part of any steps of method 300, the TRT control system 100 can perform diagnostic tests or checks. As another example, method 300 may be interrupted or paused at any time through a manual override activation on the TRT control system 100.

Figure 4:
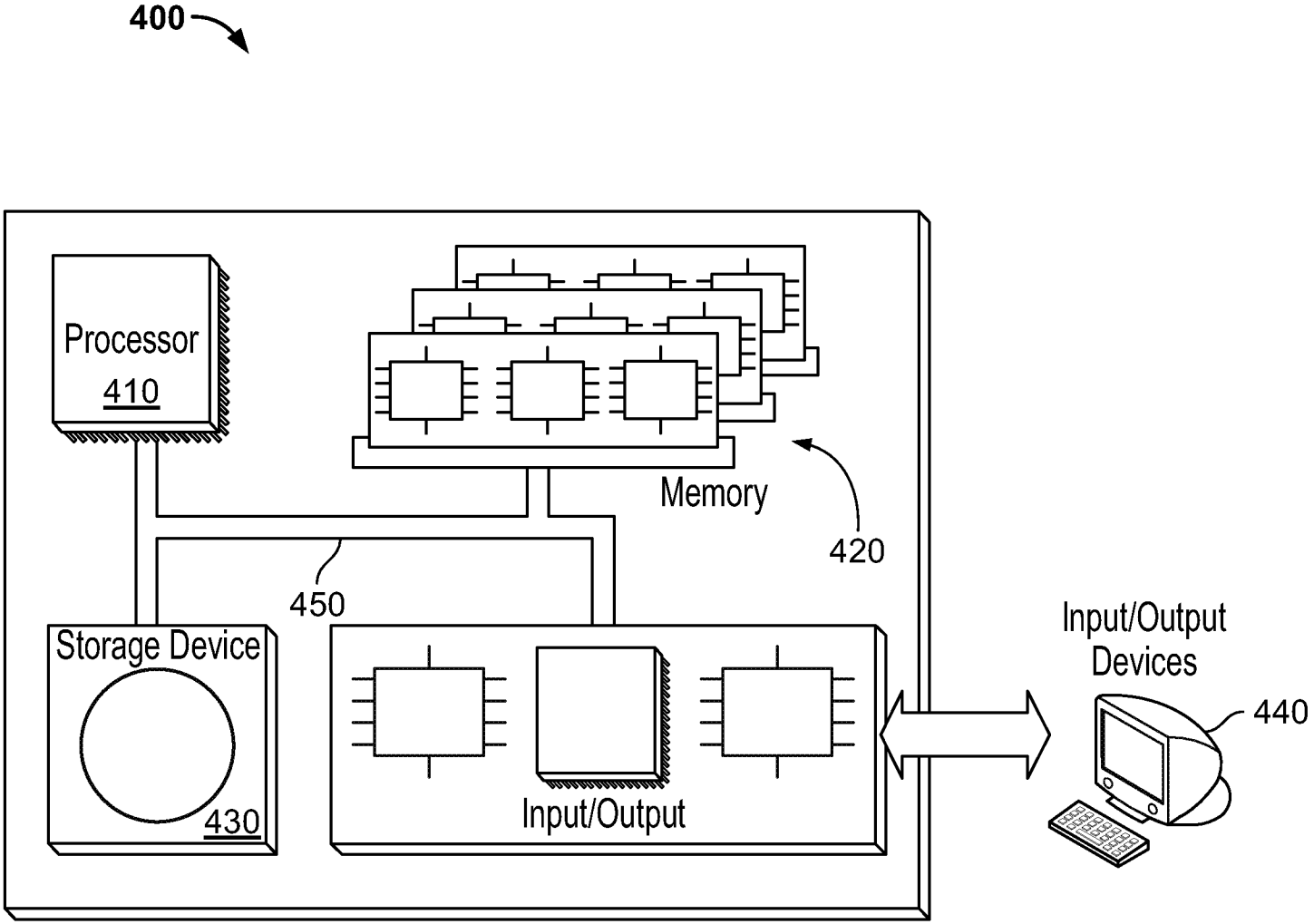
FIG. 4 is a schematic illustration of an example controller (or control system) for operating a tubular running tool control system according to the present disclosure.

FIG. 4 is a schematic illustration of an example controller 400 (or control system) for operating a tubular running tool control system, such as all or a portion of TRT control system 100 of FIGS. 1-2. For example, all or parts of the controller 400 can be used for some or all of the operations previously described. The controller 400 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 400 includes a processor 410, a memory 420, a storage device 430, and an input/output device 440. Each of the components 410, 420, 430, and 440 are interconnected using a system bus 450. The processor 410 is capable of processing instructions for execution within the controller 400. The processor may be designed using any of a number of architectures. For example, the processor 410 may be a CISC (Complex Instruction Set Computers) processor, a RISC (Reduced Instruction Set Computer) processor, or a MISC (Minimal Instruction Set Computer) processor.

In one implementation, the processor 410 is a single-threaded processor. In another implementation, the processor 410 is a multi-threaded processor. The processor 410 is capable of processing instructions stored in the memory 420 or on the storage device 430 to display graphical information for a user interface on the input/output device 440.

The memory 420 stores information within the controller 400. In one implementation, the memory 420 is a computer-readable medium. In one implementation, the memory 420 is a volatile memory unit. In another implementation, the memory 420 is a non-volatile memory unit.

The storage device 430 is capable of providing mass storage for the controller 400. In one implementation, the storage device 430 is a computer-readable medium. In various different implementations, the storage device 430 may be a floppy disk device, a hard disk device, an optical disk device, a tape device, flash memory, a solid state device (SSD), or a combination thereof.

The input/output device 440 provides input/output operations for the controller 400. In one implementation, the input/output device 440 includes a keyboard and/or pointing device. In another implementation, the input/output device 440 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A tubular running tool control system, comprising:

one or more sensors coupled to a tubular running tool of a rig system during a tubular running operation; and a controller communicably coupled to the one or more sensors and comprising one or more memory modules that stores instructions, and one or more hardware processors communicably coupled to the one or more memory modules and configured to execute the stored instructions to perform operations comprising;

identifying a first input from one or more sensors that is associated with a weight of one or more tubular members suspended from the tubular running tool of the rig system during the tubular running operation;

identifying a second input from the one or more sensors that is associated with a position of the tubular running tool of the rig system relative to a reference location during the tubular running operation;

determining, based on at least one of the first or second inputs, an operation for the tubular running tool;

based on the determination, transmitting a signal to an actuator of the tubular running tool to perform the operation of the tubular running tool;

identifying a third input from the one or more sensors that is associated with a position of the actuator of the tubular running tool during the tubular running operation;

determining, based on the third input, a location or position of a gripping assembly;

determining a lateral load on the one or more tubular members based on the determined location or position of the gripping assembly;

comparing the determined lateral load to an expected lateral load; and based on the determined lateral load being greater than the expected lateral load, activating an alert signal at the tubular running tool.

2. The tubular running tool control system of claim 1, wherein the first input is greater than a preset weight value, and the operation comprises maintaining or engaging a gripping assembly of the tubular running tool with at least one of the one or more tubular members.

3. The tubular running tool control system of claim 2, wherein the preset weight value comprises a sum of a weight of the tubular running tool and a travelling block, and the reference location is at a distance of the tubular running tool above a rotary table of the rig system.

4. The tubular running tool control system of claim 1, wherein the first input is less than a preset weight value and the second input is below the reference location for the tubular running tool, and the operation comprises disengaging a gripping assembly of the tubular running tool with at least one of the one or more tubular members.

5. The tubular running tool control system of claim 4, wherein the one or more hardware processors is configured to perform operations further comprising:

operating the tubular running tool to engage the tubular member at the reference location; and preparing the tubular running tool to engage an additional tubular member to connect to the one or more tubular members.

6. The tubular running tool control system of claim 1, wherein one or both of the first or second inputs comprises a null input, and the operation comprises:

maintaining a previous operation for the tubular running tool; and activating a sensor alarm.

7. The tubular running tool control system of claim 1, wherein the one or more hardware processors is configured to perform operations further comprising:

identifying a fourth input from the one or more sensors that is associated with a location of one or more human operators of the tubular running tool during the tubular running operation;

determining, based on the fourth input, a location at least one of the one or more human operators within a drop zone of the tubular running tool; and based on the determination, activating an alert signal at the tubular running tool.

8. The tubular running tool control system of claim 7, wherein the preset weight value comprises a sum of a weight of the tubular running tool and a travelling block, and the reference location is at a distance of the tubular running tool above a rotary table of the rig system.

9. The tubular running tool control system of claim 8, wherein one or both of the first or second inputs comprises a null input, and the operation comprises:

maintaining a previous operation for the tubular running tool; and activating a sensor alarm.

10. The tubular running tool control system of claim 1, wherein the one or more sensors are wirelessly coupled to the controller.

11. The tubular running tool control system of claim 1, wherein the one or more tubular members comprise casing or tubing.

12. A method for operating a tubular running tool system, comprising:

communicating, using a controller that comprises one or more hardware processors, with one or more sensors coupled to a tubular running tool of a rig system during a tubular running operation;

identifying, with the controller, a first input from the one or more sensors that is associated with a weight of one or more tubular members suspended from the tubular running tool of the rig system during the tubular running operation;

identifying, with the controller, a second input from the one or more sensors that is associated with a position of the tubular running tool of the rig system relative to a reference location during the tubular running operation;

based on at least one of the first or second inputs, determining, with the controller, an operation for the tubular running tool;

based on the determination, transmitting, with the controller, a signal to an actuator of the tubular running tool to perform the operation of the tubular running tool;

identifying, with the controller, a third input from the one or more sensors that is associated with a position of the actuator of the tubular running tool during the tubular running operation;

based on the third input, determining, with the controller, a location or position of a gripping assembly;

determining, with the controller, a lateral load on the one or more tubular members based on the determined location or position of the gripping assembly;

comparing, with the controller, the determined lateral load to an expected lateral load; and based on the determined lateral load being greater than the expected lateral load, activating, with the controller, an alert signal at the tubular running tool.

13. The method of claim 12, wherein the first input is greater than a preset weight value, the method further comprising:

operating, with the controller, a gripping assembly of the tubular running tool to maintain or engage with at least one of the one or more tubular members.

14. The method of claim 13, wherein the present weight value comprises a sum of a weight of the tubular running tool and a travelling block, and the reference location is at a distance of the tubular running tool above a rotary table of the rig system.

15. The method of claim 12, wherein the first input is less than a preset weight value and the second input is below the reference location for the tubular running tool, and the method further comprises:

operating, with the controller, a gripping assembly of the tubular running tool to disengage with at least one of the one or more tubular members.

16. The method of claim 15, wherein the present weight value comprises a sum of a weight of the tubular running tool and a travelling block, and the reference location comprises a distance of the tubular running tool above a rotary table of the rig system.

17. The method of claim 15, further comprising:

operating, with the controller, the tubular running tool to engage the tubular member at the reference location; and preparing, with the controller, the tubular running tool to engage an additional tubular member to connect to the one or more tubular members.

18. The method of claim 12, wherein one or both of the first or second inputs comprises a null input, and the method further comprises:

maintaining, with the controller, a previous operation for the tubular running tool.

19. The method of claim 12, further comprising:

identifying, with the controller, a fourth input from the one or more sensors that is associated with a location of one or more human operators of the tubular running tool during the tubular running operation;

based on the fourth input, determining, with the controller, a location at least one of the one or more human operators within a drop zone of the tubular running tool; and based on the determination, activating, with the controller, an alert signal at the tubular running tool.

20. The method of claim 19, wherein the present weight value comprises a sum of a weight of the tubular running tool and a travelling block, and the reference location is at a distance of the tubular running tool above a rotary table of the rig system.

21. The method of claim 12, further comprising wirelessly communicating between the one or more sensors and the controller.

* * * * *